US008020952B2

(12) United States Patent
Ito et al.

(10) Patent No.: US 8,020,952 B2
(45) Date of Patent: Sep. 20, 2011

(54) PRINTING APPARATUS, PRINTING METHOD AND COMPUTER PROGRAM

(75) Inventors: Tatsumi Ito, Kanagawa (JP); Takeshi Matsui, Tokyo (JP); Yuichiro Ikemoto, Kanagawa (JP); Koji Ashizaki, Tokyo (JP)

(73) Assignee: Sony Corporation, Tokyo (JP)

( * ) Notice: Subject to any disclaimer, the term of this patent is extended or adjusted under 35 U.S.C. 154(b) by 99 days.

(21) Appl. No.: 12/404,758

(22) Filed: Mar. 16, 2009

(65) Prior Publication Data

US 2009/0251501 A1 Oct. 8, 2009

(30) Foreign Application Priority Data

Apr. 4, 2008 (JP) ..... 2008-098337

(51) Int. Cl.
*B41J 3/00* (2006.01)
*B41J 29/38* (2006.01)
*B41J 3/407* (2006.01)

(52) U.S. Cl. ..... 347/2; 347/12; 347/106

(58) Field of Classification Search ..... 347/2; 101/38.1
See application file for complete search history.

(56) References Cited

U.S. PATENT DOCUMENTS 6,202,550 B1 * 3/2001 Lee et al. ..... 101/38.1
7,302,888 B2 * 12/2007 Huang et al. ..... 347/5
2008/0018680 A1 1/2008 Ito et al.

FOREIGN PATENT DOCUMENTS

JP 2002-127396 5/2002
JP 2008-27535 2/2008

OTHER PUBLICATIONS

U.S. Appl. No. 12/396,812, filed Mar. 3, 2009, Ito, et al.
U.S. Appl. No. 12/474,842, filed May 29, 2009, Ito, et al.

* cited by examiner

*Primary Examiner* — Shelby Fidler
(74) *Attorney, Agent, or Firm* — Oblon, Spivak, McClelland, Maier & Neustadt, L.L.P.

(57) ABSTRACT

There is provided a printing apparatus including a printing unit for printing visual information on a non-recording surface of a rotatably driven recording medium by discharging ink droplets; and a control unit for controlling movement of the printing unit in a radial direction of the rotatably driven recording medium, and controlling a discharge timing of the ink droplets discharged from the printing unit, wherein the printing unit includes a plurality of ink droplet discharge nozzles, arrayed in a line in the radial direction of the recording medium, for discharging ink droplets of different colors by the control of the control unit, and the control unit completes the printing of the visual information by reciprocating the ink droplet discharge nozzles for plural times in the radial direction of the rotatably driven recording medium.

6 Claims, 9 Drawing Sheets

PRINTING APPARATUS, PRINTING METHOD AND COMPUTER PROGRAM

BACKGROUND OF THE INVENTION

1. Field of the Invention

The present invention relates to printing apparatuses, printing methods, and computer programs, and more specifically, to a printing apparatus for printing on a non-recording surface of a recording medium that is detachably attached and rotatably driven, a printing method, and a computer program.

2. Description of the Related Art

A printing apparatus for printing information by dropping ink droplets from an ink droplet discharge nozzle for discharging ink droplets with respect to a non-recording surface of a disc-shaped recording medium such as CD, DVD, and Blu-ray disc (trademark) is known. A method of printing on the non-recording surface of the recording medium includes a method of moving the ink droplet discharge nozzle from the peripheral edge part towards the central part of the recording medium in a radial direction of the recording medium while rotating the recording medium, and dropping ink droplets onto the non-recording surface of the recording medium.

However, the discharge frequency from the ink droplet discharge nozzle for discharging the ink droplets is limited by factors such as temperature rise of the print head configured with the ink droplet discharge nozzle, ink refill, and stabilization of the meniscus. In view of such factors, the discharge frequency is assumed to be about 10 kHz in a bubble jet (registered trademark) type.

For instance, the distance from the center of the ink droplet to be dropped onto the outermost periphery of the printable region of the recording medium to the center of the recording medium is 60 mm, and printing is performed with the ink droplet on the outermost periphery at 600 dpi (about 42.3 μm). In this case, the number of rotations per one minute of the recording medium can be calculated as below.

$$\text{Linear velocity: } 42.3\times10^{-6}\ [\text{m}]\times10\times10^{3}\ [1/\text{s}]=0.423\ [\text{m/s}]$$

$$\text{Disc rotation number: } 0.423\ [\text{m/s}]\times60\ [\text{s}]/(120\times10^{-3}\times\pi)[\text{m}]\approx67.3\ [\text{rpm}]$$

In order to control the discharge timing of the ink droplets from the ink droplet discharge nozzle, it is desirable to control by using a signal of an optical pickup for reading out data from the recording surface of the recording medium and recording data on the recording surface to simplify the configuration.

However, a spindle motor used in a typical optical disc recording and reproducing device is difficult to stably rotate at 100 rpm. This is because the number of rotations that becomes a reference when recording and/or reproducing the commercially available optical disc is defined by the type of optical disc. For instance, CDs are desirably rotated at 200 rpm, the DVDs at 600 rpm, and the Blu-ray discs (trademark) at about 1000 rpm.

A technique for solving such issue and performing printing on the non-recording surface of the recording medium is disclosed in, for example, Japanese Patent Application Laid-Open No. 2008-27535. In Japanese Patent Application Laid-Open No. 2008-27535, the discharge timing from the ink droplet discharge nozzle is controlled using the signal from the optical pickup, and printing in which dots in the circumferential direction are decimated (hereinafter also referred to as "decimated printing") is executed over plural laps with respect to one radius position.

SUMMARY OF THE INVENTION

However, in printing by decimated printing described in Japanese Patent Application Laid-Open No. 2008-27535, printing in which the dots in the circumferential direction are decimated is executed over plural laps with respect to one radius position, and thus in a printing apparatus where the ink droplet discharge nozzle is arranged in a column in the radial direction of the recording medium, an ink droplet discharge nozzle from which the ink droplets are not discharged of the ink droplet discharge nozzles exists at the portion of the edge of the recording medium.

Thus, when the ink droplet discharge nozzle moves from the peripheral edge part to the central part of the recording medium, and the ink droplets are discharged from the ink droplet discharge nozzle that has paused discharging the ink droplets, the ink of the paused nozzle thickens, whereby printing may be thinned when writing out, or a line in which the ink is not discharged may form.

The present invention addresses the above-identified, and other issues associated with conventional methods and apparatuses, and it is desirable to provide a novel and improved printing apparatus for completing the printing on the non-recording surface of the recording medium so that the ink does not thicken when the ink droplet discharge nozzles are arranged in a line in the radial direction of the recording medium and printing is performed while decimating the dots in the circumferential direction with respect to one radius position, a printing method, and a computer program.

According to an embodiment of the present invention, there is provided a printing apparatus including a printing unit for printing visual information on a non-recording surface of a recording medium, which is detachably attached and rotatably driven, by discharging ink droplets; and a control unit for controlling movement of the printing unit in a radial direction of the rotatably driven recording medium, and controlling a discharge timing of the ink droplets discharged from the printing unit, wherein the printing unit includes a plurality of ink droplet discharge nozzles, arrayed in a line in the radial direction of the recording medium, for discharging ink droplets of different colors by the control of the control unit, and the control unit completes the printing of the visual information by reciprocating the ink droplet discharge nozzles for plural times in the radial direction of the rotatably driven recording medium.

According to such configuration, the printing unit prints visual information on the non-recording surface of the rotatably driven recording medium by discharging ink droplets, and the control unit controls movement of the printing unit in the radial direction of the rotatably driven recording medium, and controls the discharge timing of the ink droplets discharged from the printing unit. The printing unit includes a plurality of ink droplet discharge nozzles, arrayed in a line in the radial direction of the recording medium, for discharging ink droplets of different colors by the control of the control unit, and the control unit completes the printing of the visual information by reciprocating the ink droplet discharge nozzle for plural times in the radial direction of the rotatably driven recording medium. As a result, when the ink droplet discharge nozzles are arranged in a line in the radial direction of the recording medium, and printing is performed while decimating dots in the circumferential direction with respect to one radius position, the pause time of the ink droplet discharge nozzle can be reduced by reciprocating the ink droplet discharge nozzles over plural times in the radial direction of the rotatably driven recording medium. Consequently, the printing on the non-recording surface of the recording medium can be completed so that the ink does not thicken.

The control unit may determine the number of times to reciprocate in view of a discharge interval in which the ink droplets are stably discharged from the ink droplet discharge nozzle.

The control unit may determine the number of times to reciprocate in view of a pause period of the ink droplet discharge nozzle pausing the discharge of the ink droplets of the ink droplet discharge nozzles.

According to another embodiment of the present invention, there is provided a printing method including the steps of: generating printing data of visual information to print on a non-recording surface of a recording medium, which is detachably attached and rotatably driven; and completing the printing of the visual information on the non-recording surface of the rotatably driven recording medium by reciprocating a plurality of ink droplet discharge nozzles, which are arrayed in a line in a radial direction of the recording medium and which discharge ink droplets of different colors, for plural times in the radial direction of the recording medium based on the printing data determined in the printing data determination step.

According to another embodiment of the present invention, there is provided a computer program for causing a computer to execute the steps of: generating printing data of visual information to print on a non-recording surface of a recording medium, which is detachably attached and rotatably driven; and completing the printing of the visual information on the non-recording surface of the rotatably driven recording medium by reciprocating a plurality of ink droplet discharge nozzles, which are arrayed in a line in a radial direction of the recording medium and which discharge ink droplets of different colors, for plural times in the radial direction of the recording medium based on the printing data generated in the printing data generation step.

As described above, according to the present invention, there are provided a printing method and a computer program where when the ink droplet discharge nozzles are arranged in a line in the radial direction of the recording medium, and printing is performed while decimating the dots in the circumferential direction with respect to one radius position, the printing on the non-recording surface of the recording medium is completed so that the ink does not thicken by reciprocating the ink droplet discharge nozzles in the radial direction of the recording medium and completing the printing at one radius position by a plurality of printing operations.

DETAILED DESCRIPTION OF EMBODIMENT

Figure 1:
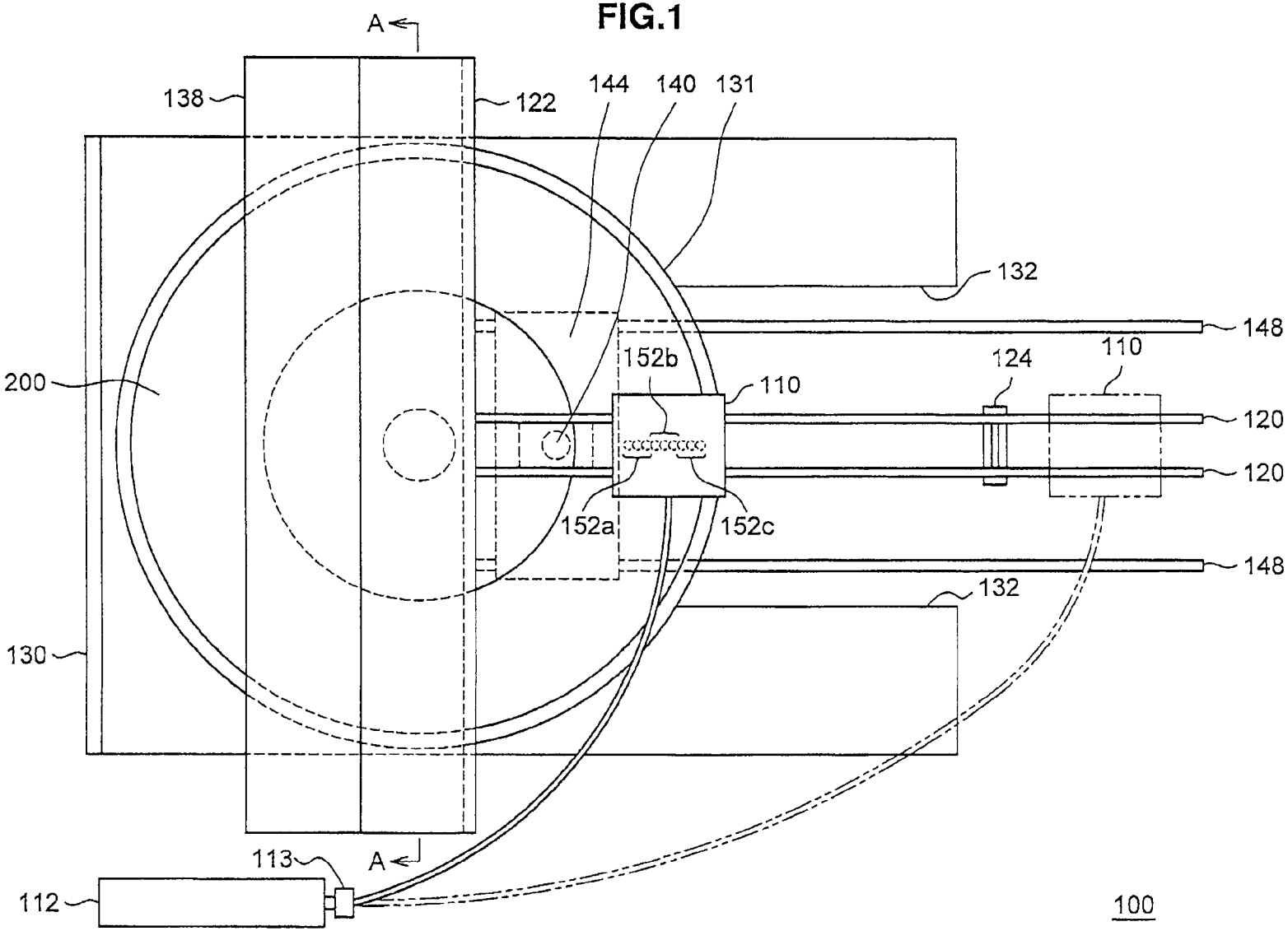
FIG. 1 is an explanatory view showing a configuration of an optical disc device 100 according to one embodiment of the present invention from an upper surface.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

Figure 9A:
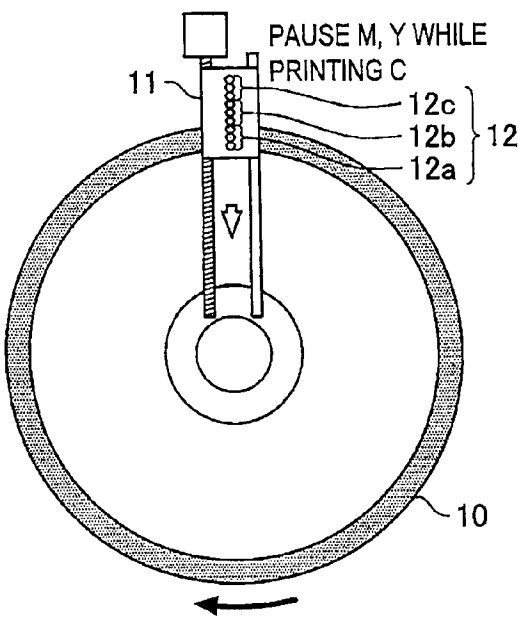
FIG.9A PRIOR ART
FIG. 9A is an explanatory view describing an outline of the decimated printing of the related art.
Figure 9B:
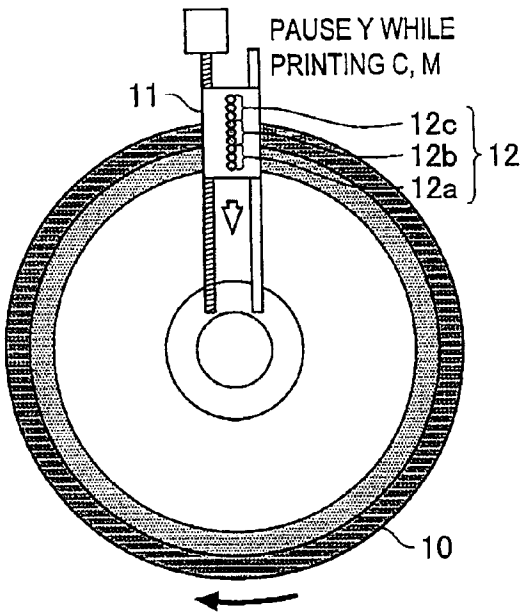
FIG.9B PRIOR ART
FIG. 9B is an explanatory view describing the outline of the decimated printing of the related art.
Figure 9C:
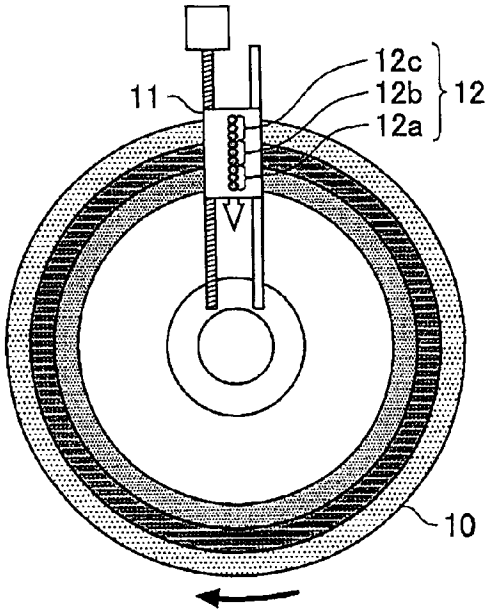
FIG.9C PRIOR ART
FIG. 9C is an explanatory view describing the outline of the decimated printing of the related art.

First, the related arts and the issues thereof will be described before describing in detail the preferred embodiments of the present invention. FIGS. 9A to 9C are explanatory views describing the outline of the decimated printing of the related art described in Japanese Patent Application Laid-Open No. 2008-27535. In FIGS. 9A to 9C, printing is performed on the non-recording surface of a recording medium 10 by dropping the ink droplets from an ink droplet discharge nozzle 12 arranged in an inkjet head 11 while rotating the non-recording surface of the recording medium 10.

The ink droplet discharge nozzle 12 has a cyan discharge nozzle 12*a*, a magenta discharge nozzle 12*b*, and a yellow discharge nozzle 12*c* arranged in a line in the radial direction of the recording medium 10. As shown in FIGS. 9A to 9C, each nozzle is arranged in the ink droplet discharge nozzle 12 in the order of the cyan discharge nozzle 12*a*, the magenta discharge nozzle 12*b*, and the yellow discharge nozzle 12*c* from the center side of the recording medium 10.

When discharging the ink droplets from the ink droplet discharge nozzle 12 having such configuration to print on the non-recording surface of the recording medium 10 from the outer side, the ink droplets of the cyan ink are first discharged towards the non-recording surface of the recording medium 10 from the cyan discharge nozzle 12*a*, as shown in FIG. 9A. In this case, the printing by the cyan discharge nozzle 12*a* is decimated printing. When discharging the ink droplets from the cyan discharge nozzle 12*a*, the magenta discharge nozzle 12*b* and the yellow discharge nozzle 12*c* are in a state of pausing the discharge of ink droplets.

After the decimated printing at the outermost peripheral portion of the non-recording surface of the recording medium 10 by the cyan discharge nozzle 12*a* is completed, the inkjet head 11 is moved by the width of the cyan discharge nozzle 12*a* in the center direction of the recording medium, as shown in FIG. 9B. The decimated printing by the cyan discharge nozzle 12*a* and the decimated printing by the magenta discharge nozzle 12*b* then become possible by moving the inkjet head 11 as in FIG. 9B. In this case, the yellow discharge nozzle 12*c* is in a state of pausing the discharge of the ink droplets.

When the decimated printing by the cyan discharge nozzle 12*a* and the magenta discharge nozzle 12*b* is performed with the inkjet head 11 at the position shown in FIG. 9B, the inkjet head 11 is moved by the width of the cyan discharge nozzle 12*a* in the center direction of the recording medium, as shown in FIG. 9C. The decimated printing by the cyan discharge nozzle 12*a*, the magenta discharge nozzle 12*b*, and the yellow discharge nozzle 12*c* then becomes possible by moving the inkjet head 11 as in FIG. 9C.

If the recording medium 10 is to be rotated at 1000 rpm when printing on the recording medium 10 in which the distance from the outermost peripheral part to the center is 60 mm at a discharge frequency of 10 kHz and a dot interval of 600 dpi, the recording medium 10 is rotated at a rotation number of about fifteen times the rotation number necessary when printing at 600 dpi or $$1000\ [\text{rpm}]/67.3\ [\text{rpm}] \approx 14.9.$$

If the method disclosed in Japanese Patent Application Laid-Open No. 2008-27535 is used in such case, a decimated printing of discharging the ink droplets from the ink droplet discharge nozzle 12 once (i.e., fourteen dot interval) every fifteen dots is performed in the printing of one lap. The printing at the radius position is completed by repeating the decimated printing at the same radius position for fifteen times.

In such case, if the inkjet head 11 is positioned as shown in FIG. 9A, the time of printing by discharging the cyan ink droplets from the cyan discharge nozzle 12 becomes $$60\ [\text{s}] \times 15 \times 2/1000\ [\text{rpm}] = 1.8\ [\text{s}].$$

The time is doubled in the equation so that when the ink droplets are discharged to the recording medium 10, the discharge of the ink droplets is not performed to align the print position in the next lap, that is, printing is performed only once every two laps due to restriction of the optical disc device.

If the movement time of the inkjet head 11 is one second, about 1.8 [s]+1 [s]=2.8 seconds is waited from the start of printing until the start of discharge of ink droplets from the magenta discharge nozzle 12*b*. About (1.8 [s]+1 [s])×2=5.6 seconds is waited from the start of printing until the start of discharge of ink droplets from the yellow discharge nozzle 12*c*. With the waiting time of such extent, thickening of the ink does not arise as an issue, and issues such as thin printing in time of write out, and formation of a line in which the ink droplets are not discharged are less likely to occur.

When performing printing on the non-recording surface of the recording medium 10 using the inkjet head, contamination of the interior of the device due to generation of so-called mist becomes an issue. The generation of mist is deeply involved in the discharging state of the ink droplets from the inkjet head. In one example, it is known that the seiche of the ink refill and the meniscus is ensured when the discharge frequency is controlled to smaller than or equal to 2.5 kHz (or ¼ of 10 kHz), whereby the discharge stabilizes and the mist reduces.

Therefore, if the discharge frequency is reduced to ¼, the decimated printing is performed at a rate of once every sixth dots equivalent to four times the pattern of performing the decimated printing at a rate of once every fifteen dots, whereby printing in which the mist is significantly is reduced can be performed.

However, if the number of dots to decimate in printing of one lap is increased, the time until the printing at the radius position is completed becomes longer. If the discharge frequency is 2.5 KHz, about 1.8 [s]×4+1 [s]=8.2 seconds is waited from the start of printing until the start of discharge of the ink droplets from the magenta discharge nozzle 12*b*. Furthermore, about (1.8 [s]×4+1 [s])×2=16.4 seconds is waited from the start of printing until the start of discharge of the ink droplets from the yellow discharge nozzle 12*c*.

Moreover, when a multi-path printing of printing while shifting the phase of the ink discharge and shifting the inkjet head 11 in the radial direction of the recording medium 10 every time the recording medium 10 makes one rotation is performed, the pause time of the magenta discharge nozzle 12*b* and the yellow discharge nozzle 12*c* becomes longer.

The multi-path printing will be described using specific numerical values. Assume 320 ink droplet discharge nozzles 12 are lined at an interval of 0.0423 mm in the radial direction of the recording medium 10 in the inkjet head 11, and the printable range of the non-recording surface of the recording medium 10 is the region of width of 37 mm of the radius 20 mm to 57 mm of the recording medium 10.

In such case, printing is performed while shifting the phase of the ink discharge from the ink droplet discharge nozzle 12 by ¼ and moving the radius position at the recording medium 10 of the inkjet head 11 by ¼ head (=3.384 mm) every time the recording medium 10 makes one rotation. The ink droplets are discharged four times from different ink droplet discharge nozzles with respect to the same radius position, and thus this printing is referred to as four-path printing. As a result, the printing is completed when the recording medium 10 makes a total of fourteen rotations. According to such multi-path printing, the variation in the ink discharge amount for every nozzle is canceled out, and the printing quality can be enhanced.

However, when the multi-path printing is performed as above, if the number of paths necessary for printing increases, the pause time of the magenta discharge nozzle 12*b* and the yellow discharge nozzle 12*c* increases with increase in the number of paths. That is, the pause time of about 32.8 seconds is generated until the discharge of the ink droplets from the yellow discharge nozzle 12*c* is started if the multi-path printing by two-path printing is performed, and about 65.6 seconds is generated until the discharge of the ink droplets from the yellow discharge nozzle 12*c* is started if four-path printing is performed. The longer pause time becomes a factor leading to thinning in time of write out or formation of a line in which the ink droplets are not discharged due to thickening of the ink.

Therefore, in the present invention, the inkjet head is reciprocated in the radial direction to complete the printing when printing on the non-recording surface of the recording medium. The pause time of the ink droplet discharge nozzle can be reduced and thinning in time of write out or generation of a line in which the ink droplets are not discharged due to thickening of the ink is suppressed by reciprocating the inkjet head in the radial direction.

The preferred embodiments of the present invention will be described in detail below with reference to the drawings.

Figure 2:
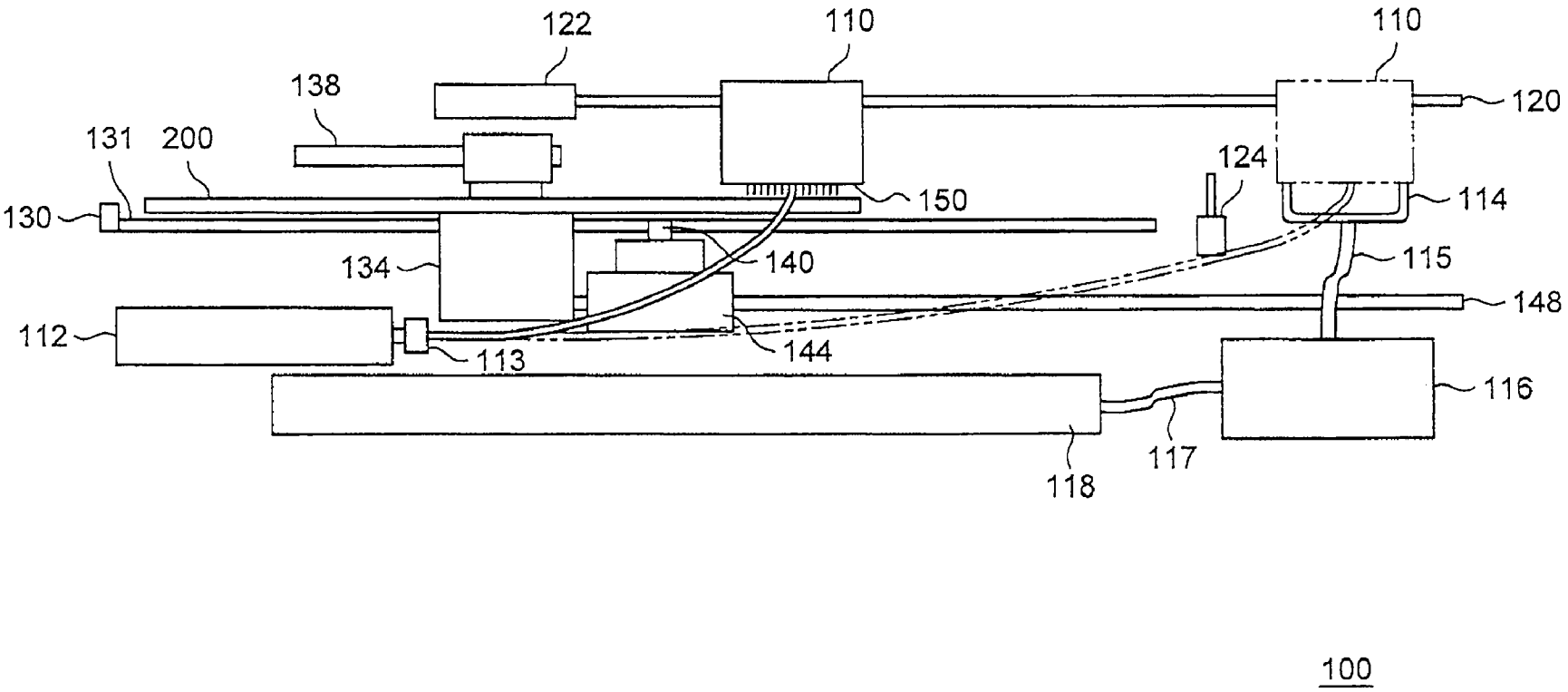
FIG. 2 is an explanatory view showing the configuration of the optical disc device 100 according to one embodiment of the present invention from a side surface.

First, a configuration of an optical disc device 100 according to one embodiment of the present invention will be described. FIG. 1 is an explanatory view showing the configuration of an optical disc device 100 according to one embodiment of the present invention from an upper surface. FIG. 2 is an explanatory view showing the configuration of the optical disc device 100 according to one embodiment of the present invention from a side surface. The configuration of the optical disc device 100 according to one embodiment of the present invention will be described using FIGS. 1 and 2.

The optical disc device 100 is one example of a printing apparatus of the embodiment of the present invention. The optical disc device 100 is configured to include a recording/reproducing unit for recording a data signal to a recording surface of an optical disc 200, serving as a recording medium of the embodiment of the present invention, and/or reproducing a data signal from the recording surface of the optical disc 200; and a printing unit for printing visual information such as characters and images on a non-recording surface (label surface) of the optical disc 200.

The printing unit is configured to include an inkjet head 110, an ink cartridge 112, a head cap 114, a suction pump 116, a discard ink absorbing body 118, a first guide shaft 120, a shaft support portion 122, and a blade 124.

The inkjet head 110 includes a plurality of ink droplet discharge nozzles 152 for discharging ink droplets onto a nozzle surface 150 facing the non-recording surface of the optical disc 200. The ink droplet discharge nozzles 152 discharges ink droplets at a predetermined ink discharge frequency through the inkjet method. The ink droplet discharge nozzles 152 include cyan discharge nozzles 152*a*, magenta discharge nozzles 152*b*, and yellow discharge nozzles 152*c*, and are arrayed in a line in the radius direction of the optical disc 200. The inkjet method is a method of discharging ink as microscopic liquid droplet from the ink droplet discharge nozzles 152 and attaching the ink to a printing material.

The inkjet head 110 is positioned on the outer side of the optical disc 200 in time of print waiting, and arranged on the upper side of the optical disc 200 in time of printing. Furthermore, the inkjet head 110 may have a function of dummy discharging the ink from the ink droplet discharge nozzles 152 before and after the printing in order to discharge thick ink, air bubbles, foreign substances, and the like of the ink droplet discharge nozzles 152.

The ink cartridge 112 accommodates ink of a predetermined color, and supplies ink to the inkjet head 110. More specifically, the ink cartridge 112 is a container made from tubular resin. A porous body (e.g., sponge, ceramics, or the like) is incorporated inside the container, and ink is stored by the capillary force of the porous body.

The ink cartridge 112 supplies ink to the inkjet head 110 through a coupling portion 113. The ink cartridge 112 is configured to be detachably attached to the coupling portion 113 so as to be easily changed when the ink runs out.

The head cap 114 is attached to the nozzle surface 150 of the inkjet head 110 in time of print waiting of waiting for the printing on the non-recording surface of the optical disc 200. The head cap 114 has a role of preventing drying of ink contained in the inkjet head 110, and attachment of foreign substances such as dust and dirt to the nozzle surface 150. When the printing on the non-recording surface of the optical disc 200 is started, the head cap 114 is separated from the nozzle surface 150. The head cap 114 may include a porous body for adsorbing ink dummy discharged from the inkjet head 110. In dummy discharging from the inkjet head 110, a valve mechanism for adjusting the internal space of the head cap 114 to an atmospheric pressure may be arranged.

The suction pump 116 is connected to the head cap 114 by way of a tube 115. According to such configuration, the suction pump 116 can suction the ink inside the inkjet head 110 by applying negative pressure to the space inside the head cap 114 when the head cap 114 is attached to the inkjet head 110. The suction pump 116 may also suction the ink dummy discharged and adsorbed by the ink head cap 114.

The discard ink absorbing body 118 is connected to the suction pump 116 by way of a tube 117. According to such configuration, the ink suctioned by the suction pump 116 can be discarded.

The first guide shaft 120 moves the inkjet head 110 in the radial direction of the optical disc 200. The movement of the inkjet head 110 may be performed by a ball screw feeding mechanism of the first guide shaft 120, or may be performed by a rack-opinion mechanism, a belt feeding mechanism, a wire feeding mechanism, or the like. The shaft support portion 122 supports one end of the first guide shaft 120.

The blade 124 is arranged between a print waiting position (position in time of print waiting) and the print position of the inkjet head 110. When the inkjet head 110 moves from the print waiting position to the print position, or when the inkjet head 110 moves from the print position to the print waiting position, the nozzle surface 150 is brushed away to the inkjet head 110 to remove ink, foreign substances, or the like attached to the nozzle surface 150. The blade 124 may be configured to move up and down, or the blade 124 may be moved up and down to choose whether or not to brush away the nozzle surface 150.

The recording/reproducing unit is configured to include a tray 130, a spindle motor 134, a chucking portion 138, an optical pickup 140, a moving stand 144, and a second guide shaft 148.

The tray 130 is provided to mount the optical disc 200. The tray 130 is made from a plate-shaped member of rectangular shape in plane slightly larger than the optical disc 200, where a disc accommodating portion 131 including a circular recess for accommodating the optical disc 200 is formed on the upper surface.

The spindle motor 134 rotates based on a control signal input from a motor drive circuit (not shown) for driving the spindle motor 134. The spindle motor 134 functions as a driver for drive the optical disc 200 in cooperation with the motor drive circuit.

The tray 130 may be formed with a cutout 132 to avoid contact with the spindle motor 134, or the like. As shown in FIG. 1, the cutout 132 may be formed large from one short side of the tray 130 to the central part of the disc accommodating portion 131.

The chucking portion 138 contacts the upper part of the spindle motor 134. The optical disc 200 accommodated in the disc accommodating portion 131 rotates by the rotation of the spindle motor 134, and rises from the disc accommodating portion 131. The chucking portion 138 holds down from above the optical disc 200 rose from the disc accommodating portion 131. The separation of the optical disc 200 from the disc accommodating portion 131 is prevented by holding down the optical disc 200 with the chucking portion 138 from above.

The optical pickup 140 is an optical system module configured to include a photodetector, an objective lens, a biaxial actuator for facing the objective lens to the recording surface of the optical disc 200, and the like. The photodetector of the optical pickup 140 is configured by a semiconductor laser serving as a light source for emitting light beam, a light receiving element for receiving the light beam reflected by and returned from the recording surface of the optical disc 200, and the like. The optical pickup 140 emits the light beam from the semiconductor laser, collects the light beam by the objective lens, irradiates the recording surface of the optical disc 200 and receives the light beam reflected by the recording surface with the photodetector to write the information signal on the recording surface of the optical disc 200, and/or read the information signal from the recording surface of the optical disc 200.

The moving stand 144 is provided to mount the optical pickup 140, and is movable by the second guide shaft 148 in the radial direction of the optical disc 200. The second guide shaft 148 moves the moving stand 144 in the radial direction of the optical disc 200. The movement of the moving stand 144 may be performed by a ball screw feeding mechanism of the second guide shaft 148, or may be performed by a rack-opinion mechanism, a belt feeding mechanism, a wire feeding mechanism, or the like.

The configuration of the optical disc device 100 according to one embodiment of the present invention has been described using FIGS. 1 and 2. The configuration of the optical disc 200 will now be described.

Figure 3:
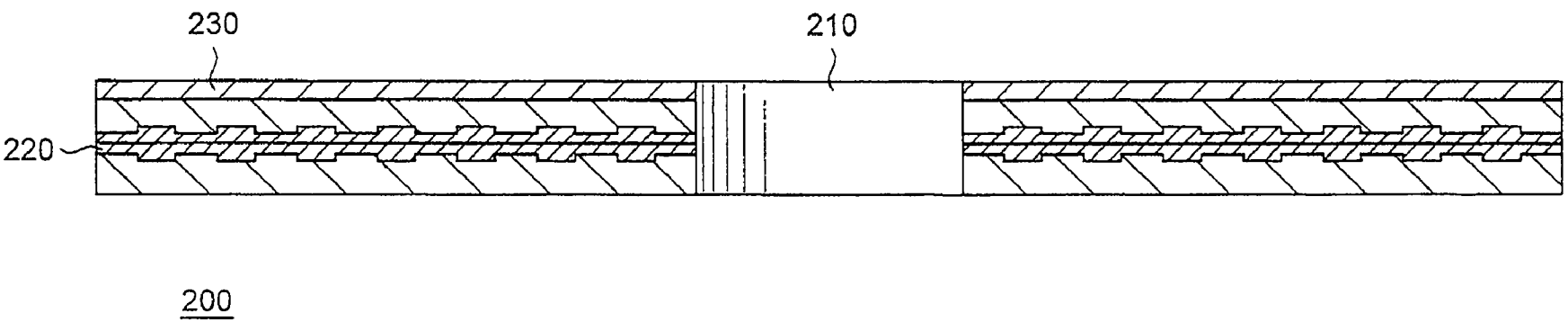
FIG. 3 is an explanatory view schematically showing the cross-section taken along line A-A of FIG. 1 of the optical disc 200.

FIG. 3 is an explanatory view schematically showing the cross-section taken along line A-A of FIG. 1 of the optical disc 200. The configuration of the optical disc 200 will be described below using FIG. 3.

As shown in FIG. 3, the optical disc 200 is configured to include a center hole 210, a recording surface 220, and a non-recording surface 230.

The center hole 210 is a circular hole formed at a central part of the optical disc 200 to allow the optical disc 200 to be fitted to the spindle motor 134 and the chucking portion 138. The diameter of the center hole 210 is desirably about 15 to 16 mm.

The recording surface 220 is configured to include a data signal recording region on which various information are recorded, and a reference signal recording region for detecting a rotational angle of the optical disc 200. For instance, in the case of the DVD-R, the data signal recording region is formed by a spiral-shaped land-groove structure. The configuration of the recording surface 220 of the optical disc 200 will be hereinafter described in detail.

The non-recording surface 230 functions as a reception layer (visual information printing layer) of the ink in inkjet printing, and is formed such that label information such as characters, symbols, and pictures can be printed. The printable range of the non-recording surface 230 may be a doughnut-shaped region having a radius of 20 to 57 mm and a width of about 37 mm of the optical disc 200. The non-recording surface 230 may be formed by attaching a paper to one surface of the optical disc 200.

In the present embodiment, the optical disc 200 is used as one example of the recording medium of the embodiment of the present invention, but the present invention is not limited to such example. The recording medium may be a magnetic disc, a magneto-optical disc, an electrically rewritable flash memory, or the like.

The configuration of the optical disc 200 has been described above using FIG. 3. The flow of control of the printing unit and the recording/reproducing unit in the optical disc device 100 according to one embodiment of the present invention will now be described.

Figure 4:
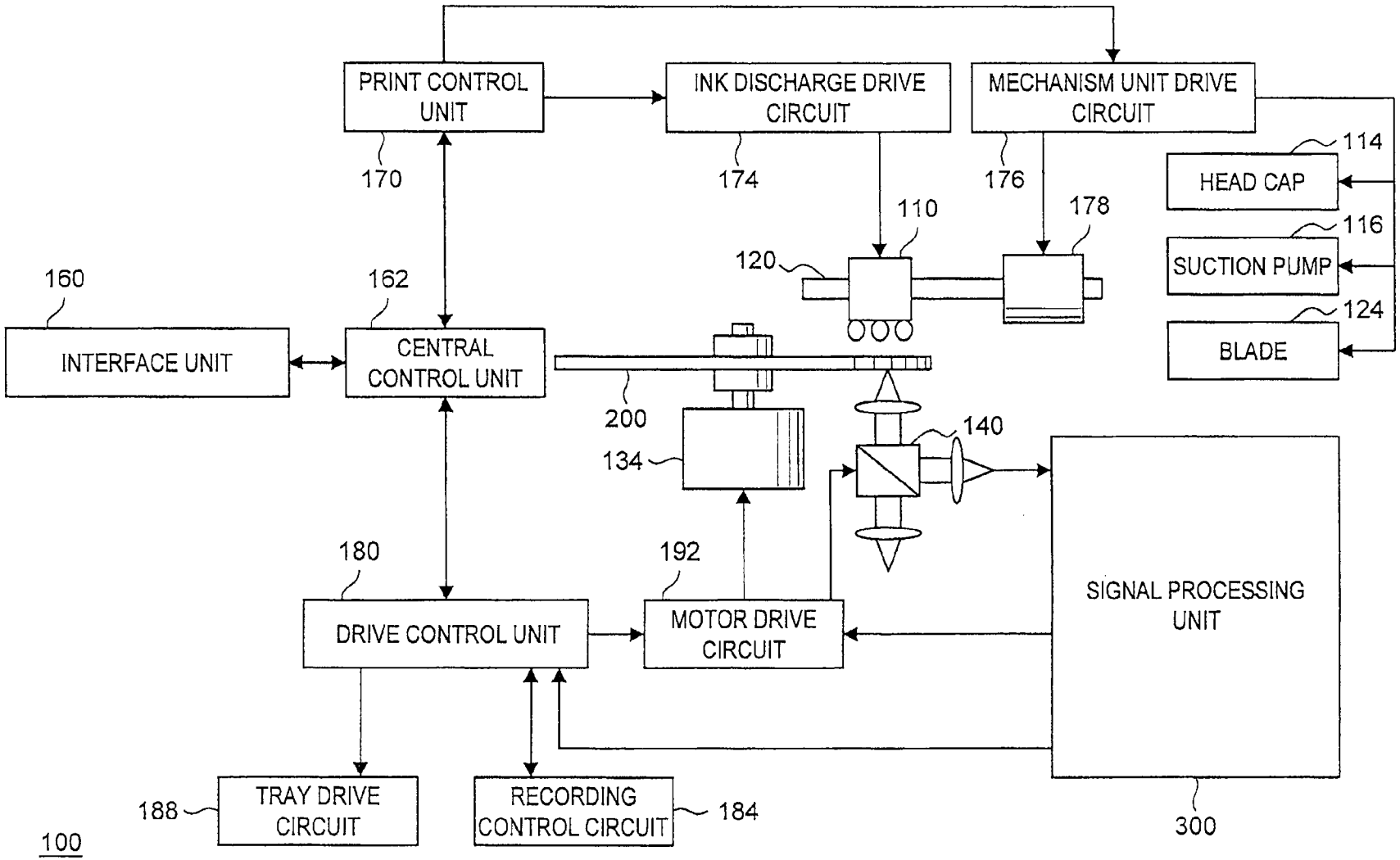
FIG. 4 is an explanatory view describing the function configuration of the optical disc device 100 according to one embodiment of the present invention.

FIG. 4 is an explanatory view describing the function configuration of the optical disc device 100 according to one embodiment of the present invention. The function configuration of the optical disc device 100 according to one embodiment of the present invention will now be described using FIG. 4.

As shown in FIG. 4, the optical disc device 100 according to one embodiment of the present invention is configured to include an interface unit 160, a central control unit 162, a print control unit 170, an ink discharge drive circuit 174, a mechanism drive circuit 176, a head drive motor 178, a drive control unit 180, a recording control circuit 184, a tray drive circuit 188, a motor drive circuit 192, and a signal processing unit 300.

The interface unit 160 is a connection unit enabling the optical disc device 100 and an external device (not shown) to communicate signals. The external device may be a personal computer, DVD recorder, Blu-ray disc (trademark) recorder, or the like. When the data signal to record on the recording surface 220 of the optical disc 200 and the visual information to print on the non-recording surface 230 are input from the external device, the interface unit 160 outputs the input signal and information to the central control unit 162. The interface unit 160 also outputs data signal read out from the recording surface 220 of the optical disc 200 by the optical disc device 100 to the external device.

The central control unit 162 performs the overall control of the optical disc device 100. Specifically, the central control unit 162 performs polar coordinate conversion on the visual information input from the interface unit 160 and outputs to the print control unit 170, or outputs the data signal input from the interface unit 160 to the drive control unit 180. The central control unit 162 also outputs a reference signal output from the drive control unit 180 to the print control unit 170.

The print control unit 170 outputs the signal for controlling the printing of the visual information to the ink discharge drive circuit 174 and the mechanism unit drive circuit 176, respectively based on the input of the polar coordinate converted visual information and the reference signal from the central control unit 162. The print control unit 170 generates ink discharge data based on the image data obtained by the image data signal provided from the central control unit 162. The generation of the ink discharge data will be hereinafter described in detail.

The ink discharge drive circuit 174 drives the inkjet head 110, and discharges ink droplets from the inkjet head 110 with respect to the non-recording surface of the optical disc 200. For instance, the ink discharge drive circuit 174 may be an electrode pair arranged in the inkjet head 110, where the ink droplets are discharged by creating a potential difference between the electrode pairs based on the signal input from the print control unit 170. That is, the electrode pair deforms when the potential difference is created between the electrode pairs, thereby compressing the ink tank holding the tank and discharging the ink droplets.

In FIG. 4, the ink discharged from the nozzle surface 150 of the inkjet head 110 is schematically shown in the form of water droplets. The inkjet head according to the embodiment of the present invention is not limited to such configuration, and the inkjet head which discharges ink droplets from the inkjet head 110 by generating heat may be used.

The mechanism drive circuit 176 drives the head cap 114, the suction pump 116, the blade 124, and the head drive motor 178. The head drive motor 178 is a motor for rotating the first guide shaft 120 to move the inkjet head 110 in the radial direction of the optical disc 200.

The drive control unit 180 controls recordation of the data signal to the recording surface 220 of the optical disc 200, and reproduction of the data signal from the recording surface 220. The drive control unit 180 may also control the rotation speed of the optical disc 200 when recording the data signal on the optical disc 200 or reproducing the data signal from the optical disc 200.

The recording control circuit 184 performs encode processing, modulation processing, and the like of the data signal such as music signal and video signal. The tray drive circuit 188 drives the tray 130 to be mounted with the optical disc 200.

The motor drive circuit 192 drives the spindle motor 134 and the optical pickup drive motor (not shown) for driving the optical pickup 140 based on the control of the drive control unit 180. The spindle motor 134 rotates the optical disc 200 by the motor drive circuit 192, and the optical pickup drive motor moves the position in the radial direction of the optical pickup 140 by the motor drive circuit 192.

The signal processing unit 300 performs processes such as demodulation, error detection, and correction of the RF (Radio Frequency) signal input from the optical pickup 140 to reproduce the data signal or generate a tracking signal.

The function configuration of the optical disc device 100 according to one embodiment of the present invention has been described using FIG. 4. The printing method using the optical disc device 100 according to one embodiment of the present invention will now be described.

Figure 5:
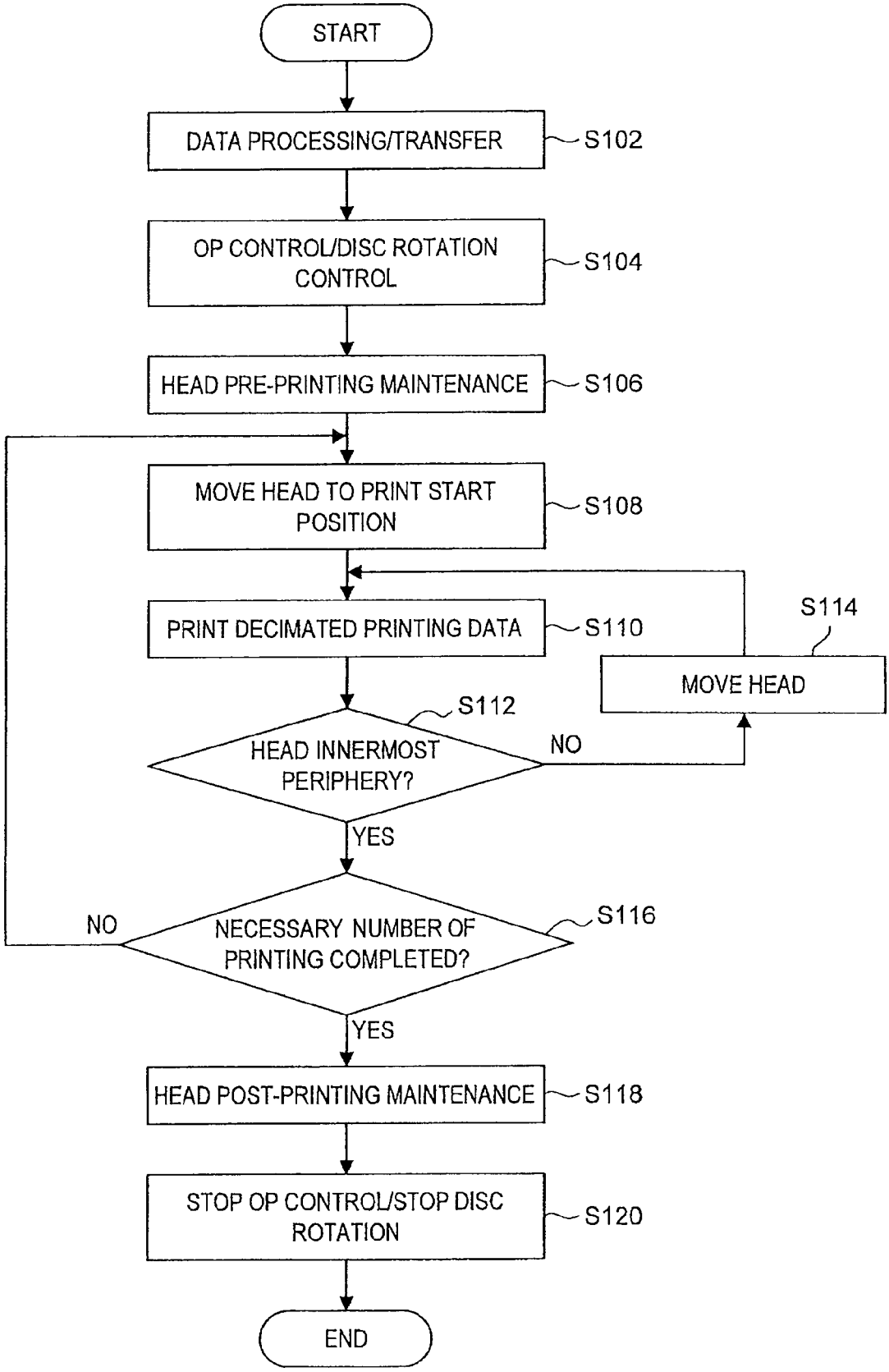
FIG. 5 is a flowchart describing a printing method using the optical disc device 100 according to one embodiment of the present invention.
Figure 6:
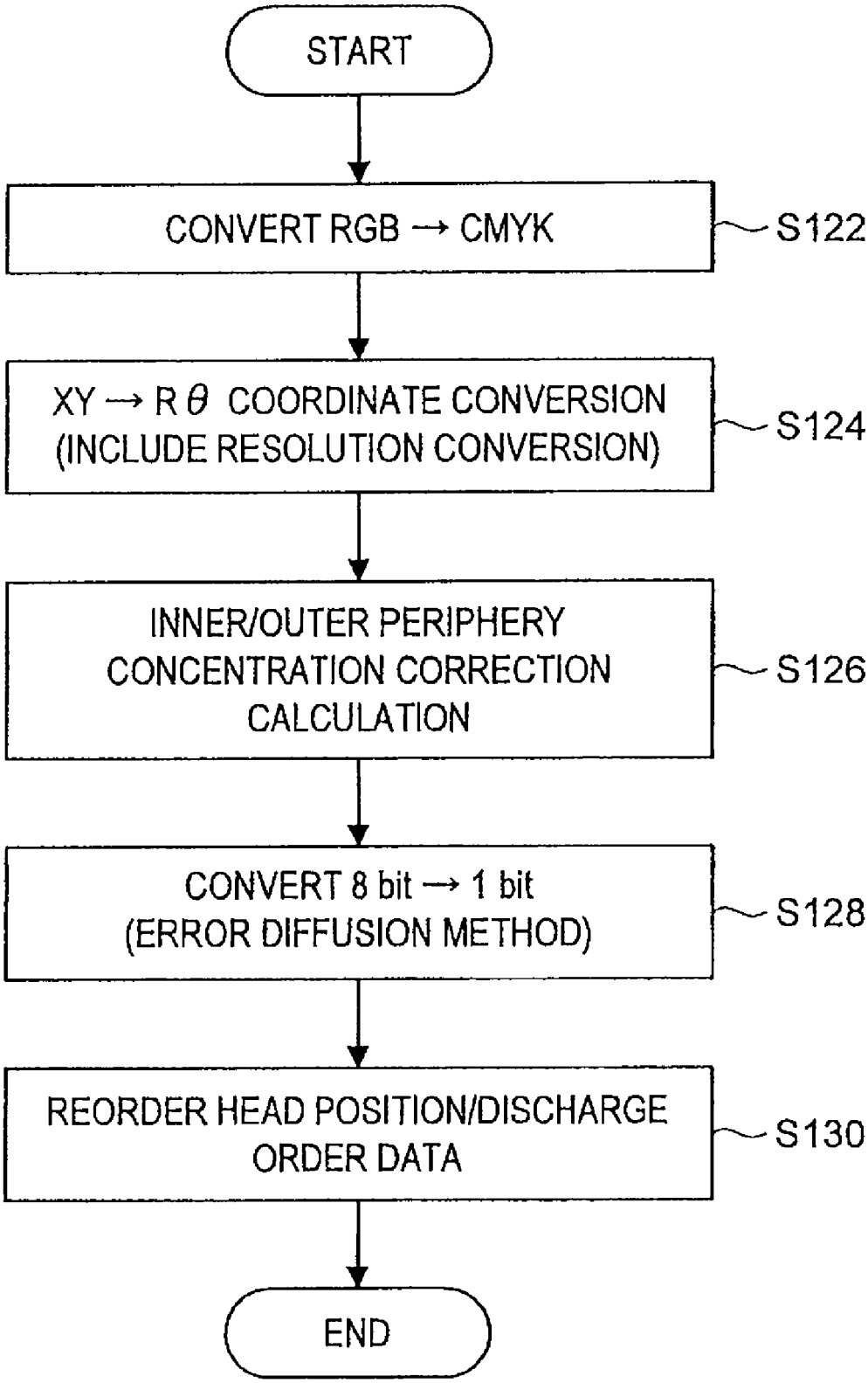
FIG. 6 is a flowchart describing the printing method using the optical disc device 100 according to one embodiment of the present invention.

FIGS. 5 and 6 are flowcharts describing the printing method using the optical disc device 100 according to one embodiment of the present invention. The printing method using the optical disc device 100 according to one embodiment of the present invention will be described below using FIGS. 5 and 6.

The outline of the printing method on the non-recording surface 230 of the optical disc 200 using the optical disc device 100 according to one embodiment of the present invention will be described first using FIG. 5. In order to print on the non-recording surface 230 using the optical disc device 100, the printing data is first processed to generate ink discharge data in the print control unit 170, and the ink discharge data is transferred to the ink discharge drive circuit 174 (step S102).

The method described in, for example, Japanese Patent Application Laid-Open No. 2008-27535 may be used in the generation of the ink discharge data by the print control unit 170, but one example of a generating method of the ink discharge data by the print control unit 170 will be described here with reference to the drawings.

FIG. 6 is a flowchart describing one example of the generating method of the ink discharge data by the print control unit 170 of the optical disc device 100 according to one embodiment of the present invention. One example of the generating method of the ink discharge data by the print control unit 170 will be described below using FIG. 6.

In order to generate the ink discharge data, the image data expressed with a tone value of each color of R (red), G (green), and B (blue) is converted to CMYK data expressed by dot (pixel) distribution of each color of C (cyan), M (magenta), Y (yellow), and K (black) (step S122). Each dot expressing the CMYK data has a respective tone value based on the image data before conversion. The tone value takes a value of between 0 and 255 (eight bits) in the present embodiment. It should be recognized that the range of the tone value is not limited to such example.

After the conversion to the CMYK data is completed, the data of each color of the CMYK data expressed in the biaxial orthogonal coordinate is then converted to polar coordinate (Rθ) data (step S124). In the conversion from the biaxial orthogonal coordinate to the polar coordinate, the resolution is converted through a general method of nearest neighbor method, bilinear method, bicubic method, or the like, and converted to the polar coordinate data corresponding to the size of the non-recording surface 230 of the optical disc 200.

After the conversion of the data of each color of the CMYK data to the polar coordinate data is completed, inner/outer periphery concentration correction calculation of the non-recording surface 230 of the optical disc 200 is performed (step S126). The inner/outer periphery concentration correction calculation is a calculation for weighting the tone value of each dot of the polar coordinate data. Specifically, the inner/outer periphery concentration correction calculation is a calculation of reducing the tone value of the dot towards the inner periphery side of the polar coordinate data.

The weight by the inner/outer periphery concentration correction may be calculated by the ratio of the number of dots per unit area having a dot to be weighted as a center and the number of dots per unit area having a dot positioned on the outermost periphery of the polar coordinate data as a center. In the present embodiment, the weight is approximately calculated by the ratio of the radius value of the dot to be weighted and the radius value of the dot positioned on the outermost periphery of the polar coordinate data.

Assuming the radius value of the dot $d_i$ to be weighted is $r_i$, and the radius value of the dot $d_N$ positioned on the outermost periphery of the polar coordinate data is $r_N$, the weight $W(d_i)$ with respect to the dot $d_i$ is calculated by $W(d_i)=r_i/r_N$. For instance, if the radius value $r_i$ of the dot $d_i$ is $r_i$=30 mm, and the radius value $r_N$ of the dot $d_N$ is $r_N$=60 mm, the weight $W(d_i)$ is 0.5.

The weight with respect to the dots positioned on the same radius value is set to the same weight by approximately calculating the weight W with respect to each dot. Thus, the number of weights to be stored in the memory (not shown) then can be reduced, the capacity of the memory can be reduced, and the power consumption of the memory can be suppressed.

The inner/outer periphery concentration correction calculation may use the method disclosed in Japanese Patent Application Laid-Open No. 2008-27534 other than the above-described method. Japanese Patent Application Laid-Open No. 2008-27534 discloses a method of setting a dropping position (i.e., position at where whether to drop or not is determined) of the ink droplets with respect to the printing surface of the rotatably driven recording medium so as to be at equal interval in the peripheral direction of the printing object, and performing printing of visual information at substantially uniform printing concentration in the printing surface.

After the inner/outer periphery concentration correction calculation is completed, a binarization process of converting the data of each color of the CMYK data after the correction to the data of one bit is performed to generate the ink discharge data (step S128). In the present embodiment, the binarization process is performed by the error diffusion method. The error diffusion method includes Floyd-Steinberg type, Jarvis, Judice & Ninke type, and the like.

The ink discharge data generated in step S128 is data representing whether or not to drop the ink droplets to the position to which each dot corresponds in the non-recording surface 230 of the optical disc 200. In the present embodiment, the tone value of each dot of the binarized ink discharge data is expressed with 0 and 1 (one bit). The ink droplets are dropped to the corresponding dot on the non-recording surface 230 of the optical disc 200 with respect to the dot which tone value is "1", and the ink droplets are not dropped to the dot which tone value is "0".

After the generation of the ink discharge data is completed in step S128, the ink discharge data is sorted according to the number of ink droplet discharge nozzles 152 lined in the radial direction of the optical disc 200, discharge frequency from the ink droplet discharge nozzles 152, and the rotation speed of the optical disc 200 (step S130). The sorting of the ink discharge data includes dividing the ink discharge data according to the number of ink droplet discharge nozzles 152 and changing the ink discharge order in performing decimated printing according to the rotation speed of the optical disc 200.

For instance, when the discharge frequency from the ink droplet discharge nozzles 152 is 2.5 kHz, the rotation number of the optical disc 200 is 1000 rpm, and the outermost periphery of the optical disc 200 is printed at 600 dpi, the decimated printing at a rate of once every 60 dots is performed, as described above.

Figure 7A:
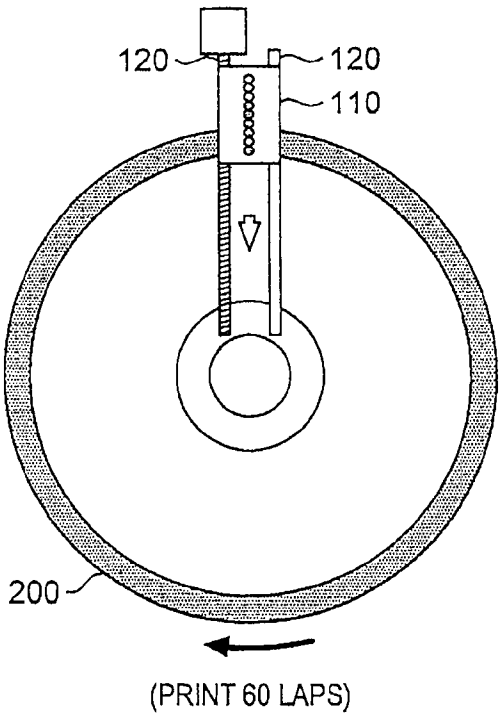
FIG. 7A is an explanatory view describing a decimated printing of discharging the ink droplets at a rate of once every 60 dots.
Figure 7B:
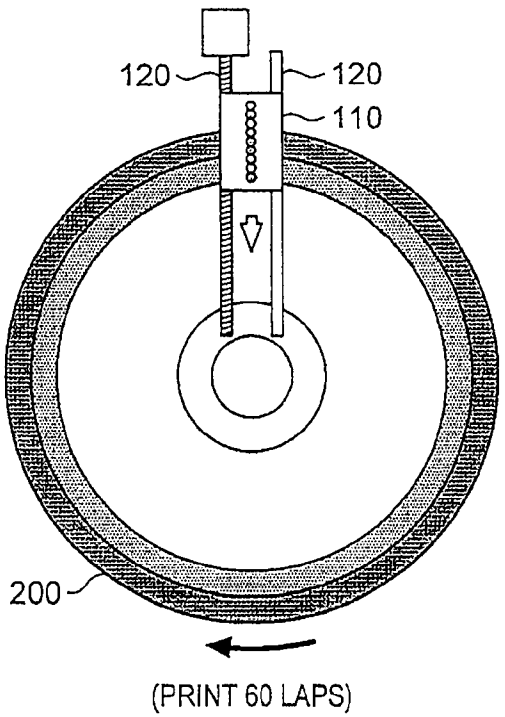
FIG. 7B is an explanatory view describing the decimated printing of discharging the ink droplets at a rate of once every 60 dots.
Figure 7C:
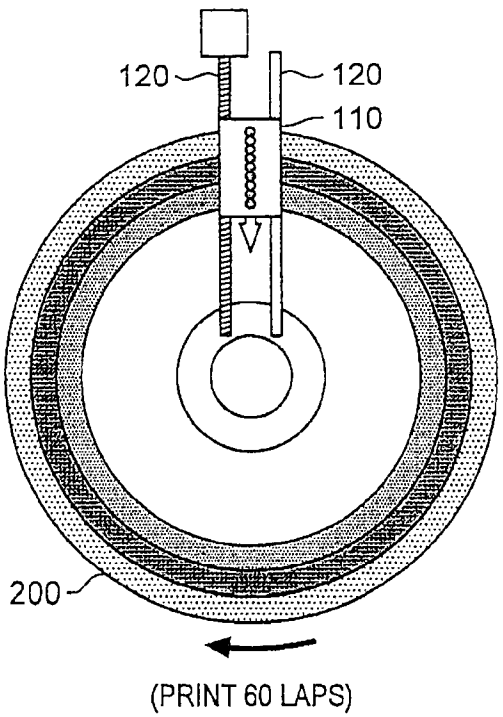
FIG. 7C is an explanatory view describing the decimated printing of discharging the ink droplets at a rate of once every 60 dots.

FIGS. 7A to 7C are explanatory views describing the decimated printing of discharging the ink droplets at a rate of once every 60 dots. As shown in FIG. 7A, the printing by the discharge of the ink droplets from the cyan discharge nozzles 152*a* is first executed for 60 laps at the outermost peripheral part of the optical disc 200.

After the printing by the discharge of the ink droplets from the cyan discharge nozzles 152*a* is completed, the printing by the discharge of the ink droplets from the magenta discharge nozzles 152*b* is then executed for 60 laps at the outermost peripheral part of the optical disc 200, as shown in FIG. 7B. In this case, the printing by the discharge of the ink droplets from the cyan discharge nozzles 152*a* is performed at the inner side of the outermost peripheral part of the optical disc 200 by the width of the cyan discharge nozzles 152*a*.

Thereafter, the printing by the discharge of the ink droplets from the yellow discharge nozzles 152*c* is then executed for 60 laps at the outermost peripheral part of the optical disc 200, as shown in FIG. 7C. In this case, the printing by the discharge of the ink droplets from the magenta discharge nozzles 152*b* is performed at the inner side of the outermost peripheral part of the optical disc 200 by the width of the cyan discharge nozzles 152*a*. Furthermore, the printing by the discharge of the ink droplets from the cyan discharge nozzles 152*a* is performed at the inner side of the outermost peripheral part of the optical disc 200 by the width of the cyan discharge nozzles 152*a*.

The printing is thus sequentially performed to the innermost peripheral part of the printable region of the non-recording surface 230 in such manner, and the printing on the non-recording surface 230 is completed.

If printing from the nozzle of another color is not executed until the printing from the cyan discharge nozzles 152*a* is completed for 60 laps at the outermost peripheral part of the optical disc 200, a waiting time of 8 seconds or longer arises at the magenta discharge nozzles 152*b*, and 16 seconds or longer at the yellow discharge nozzles 152*c*. Furthermore, the waiting time becomes longer when performing the multi-path printing to enhance the printing quality. Therefore, in the present embodiment, the waiting time of the ink droplet discharge nozzles 152 is reduced by performing only part of the decimated printing in one printing and moving the inkjet head 110 when performing the decimated printing.

Figure 8A:
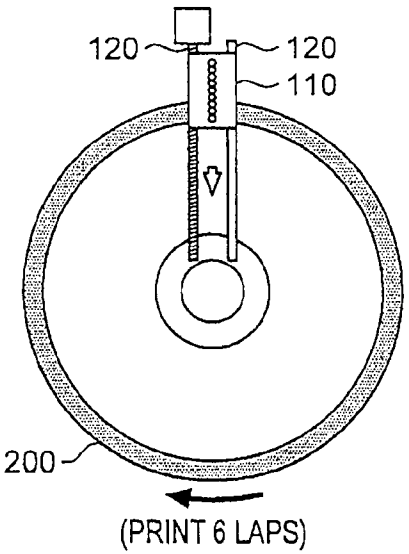
FIG. 8A is an explanatory view showing printing on a non-recording surface 230 by the printing method according to one embodiment of the present invention.
Figure 8B:
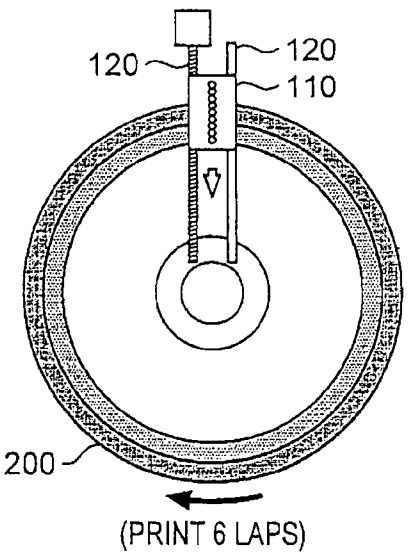
FIG. 8B is an explanatory view showing printing on the non-recording surface 230 by the printing method according to one embodiment of the present invention.
Figure 8C:
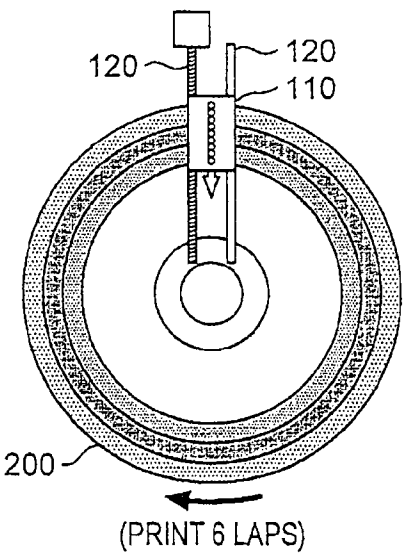
FIG. 8C is an explanatory view showing printing on the non-recording surface 230 by the printing method according to one embodiment of the present invention.

FIGS. 8A to 8D are explanatory views showing printing on the non-recording surface 230 by the printing method according to one embodiment of the present invention. When performing the decimated printing at a rate of once every 60 dots, printing of only the cyan discharge nozzles 152 is performed for only six laps at the outermost periphery of the optical disc 200, as shown in FIG. 8A. At the point the printing of six laps of the cyan discharge nozzles 152*a* is completed, the inkjet head 110 is moved, and thereafter, the printing by the cyan discharge nozzles 152*a* and the magenta discharge nozzles 152*b* is performed for six laps, as shown in FIG. 8B. Furthermore, the printing by the cyan discharge nozzles 152*a*, the magenta discharge nozzles 152*b*, and the yellow discharge nozzles 152*c* is performed for six laps, as shown in FIG. 8C.

Figure 8D:
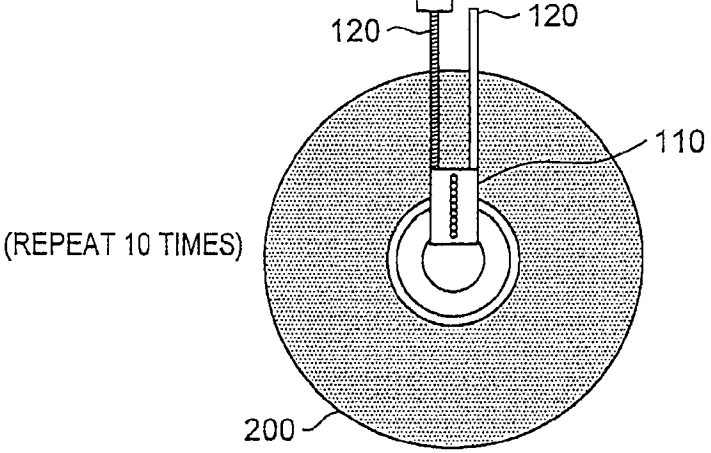
FIG. 8D is an explanatory view showing printing on the non-recording surface 230 by the printing method according to one embodiment of the present invention.

After the inkjet head 110 is moved and only part of the decimated printing is performed to the innermost peripheral part of the printable region of the non-recording surface 230, as shown in FIG. 8D, the inkjet head 110 is moved to the outer peripheral part of the optical disc 200, and the printing of only the cyan discharge nozzles 152*a* is performed for only six laps at the outermost periphery of the optical disc 200. The decimated printing of 60 dots is completed by repeating the printing of only six laps for ten times thereafter.

If the inkjet head 110 is moved after performing the printing of only six laps, the waiting time of the magenta discharge nozzles 152*b* becomes, $$60\ [s]\times 6\times 2/1000\ [rpm]+1=1.72\ [s]$$

and the waiting time of the yellow discharge nozzles 152*c* becomes, $$1.72\ [s]\times 2=3.44\ [s].$$

Therefore, the waiting time can be greatly reduced compared to when moving the inkjet head 110 after completing the printing of 60 laps.

Therefore, the waiting time of the ink droplet discharge nozzles 152 can be reduced while performing the decimated printing by performing only part of the decimated printing in one printing and then moving the inkjet head 110. Therefore, the mist reduces by the seiche of the ink refill and the meniscus, and friction in time of write-out from the ink droplet discharge nozzles 152 can be suppressed.

One example of the generating method of the ink discharge data by the print control unit 170 has been described above using FIG. 6. In the above example, a case of repeating the decimated printing, which is completed in 60 laps, six laps at a time for ten times has been illustratively described, but is should be apparent that the present invention is not limited to such example. The number of repetitions, that is, the number of times to reciprocate the inkjet head 110 may be determined by the print control unit 170 in view of the discharge frequency (discharge interval) at which the ink droplets can be stably discharged from the ink droplet discharge nozzles 152. The number of times to reciprocate the inkjet head 110 may be determined by the print control unit 170 in view of the pause period of the ink droplet discharge nozzle in which the discharge of the ink droplets is paused of the ink droplet discharge nozzles 152.

For instance, if the waiting time of the yellow discharge nozzles 152*c* is about five to six seconds, as described above, the thickening of the ink does not arise as an issue. Therefore, if the inkjet head 110 is moved after performing printing for only 15 laps when performing the decimated printing of 60 dots, the waiting time of the magenta discharge nozzles 152*b* becomes, $$60\ [s]\times 15\times 2/1000\ [rpm]+1=2.8\ [s]$$

and the waiting time of the yellow discharge nozzles 152*c* becomes, $$2.8\ [s]\times 2=5.6\ [s].$$

If the inkjet head 110 is moved after performing printing for 15 laps, the number of reciprocations of the inkjet head 110 is only four times, and thus the time desired until the printing on the non-recording surface 230 is completed can be reduced.

Furthermore, if the ink droplets can be stably discharged with the discharge frequency of the ink droplet set to greater than 2.5 kHz, the number of dots to decimate can be reduced when performing the decimated printing. For instance, if the discharge frequency of the ink droplets can be set to 5 kHz, the printing on the non-recording surface 230 can be performed by the decimated printing of 30 dots. Therefore, if the inkjet head 110 is moved after performing the printing for six laps, as described above, the number of reciprocations of the inkjet head 110 is only five times, and the time desired until the printing on the non-recording surface 230 is completed can be reduced.

After the generation of the ink discharge data in the print control unit 170 and the transfer of the ink discharge data to the ink discharge drive circuit 174 are completed in step S102, the rotation of the optical disc 200 and the drive of the optical pickup 140 (Optical Pickup; OP) are controlled (step S104). Thereafter, pre-printing maintenance is executed on the inkjet head 110 (step S106). The pre-printing maintenance on the inkjet head 110 includes removal of ink remaining on the surface of the ink droplet discharge nozzles 152 by brushing away the nozzle surface 150 using the blade 124, or the like.

After the pre-printing maintenance on the inkjet head 110 is completed, the inkjet head 110 is moved to the print start position (step S108). After the movement of the inkjet head 110 to the print start position is completed, printing by the decimated printing data is started on the non-recording surface 230 of the optical disc 200 (step S110). In the printing by the decimated printing data, part of the decimated printing data is printed from the outermost periphery towards the inner side of the optical disc 200, as described above.

After the printing on the non-recording surface 230 of the optical disc 200 from the inkjet head 110 at the relevant position is completed, whether the position of the inkjet head 110 is positioned at the innermost periphery is determined (step S112).

If the position of the inkjet head 110 is not at the innermost periphery as a result of the determination in step S112, the inkjet head 110 is moved to the inner side in the radial direction of the optical disc 200 (step S114), and the printing by the decimated printing data is continued. If the position of the inkjet head 110 is at the innermost periphery as a result of the determination in step S112, whether the necessary number of printing (e.g., ten times in the above example) is completed is determined (step S116).

If determined that the necessary number of printing is not completed as a result of the determination in step S116, the process returns to step S108, the inkjet head 110 is moved to the print start position, and the printing from the outermost peripheral part of the optical disc 200 is repeated. If determined that the necessary number of printing is completed as a result of the determination in step S116, the post-printing maintenance is executed on the inkjet head 110 (step S118). The post-printing maintenance on the inkjet head 110 includes removal of ink remaining on the surface of the ink droplet discharge nozzles 152 by brushing away the nozzle surface 150 using the blade 124, or the like.

After the post-printing maintenance on the inkjet head 110 in step S118 is completed, the rotation of the optical disc 200 and the drive of the optical pickup 140 are stopped (step S120), and the printing on the non-recording surface 230 of the optical disc 200 is completed.

The printing method using the optical disc device 100 according to one embodiment of the present invention has been described above using FIGS. 5 and 6. As described above, according to the optical disc device 100 and the printing method using the optical disc device 100 of one embodiment of the present invention, the inkjet head 110 is moved after performing only part of the decimated printing in one printing. The waiting time of the ink droplet discharge nozzles 152 can be reduced while performing the decimated printing by controlling the movement of the inkjet head 110. Therefore, the mist reduces by the seiche of the ink refill and the meniscus, and friction in time of write-out from the ink droplet discharge nozzles 152 can be suppressed.

The printing method using the optical disc device 100 according to one embodiment of the present invention described above may be carried out by storing a computer program in the optical disc device 100, and having the central control unit 162 sequentially read out the stored computer program. For instance, the print control unit 170 and the ink discharge drive circuit 174 may be controlled, and the printing may be executed on the non-recording surface 230 of the optical disc 200 by executing the relevant program.

The present application contains subject matter related to that disclosed in Japanese Priority Patent Application JP 2008-98337 filed in the Japan Patent Office on Apr. 8, 2008, the entire contents of which hereby incorporated herein by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A printing apparatus comprising:

a printing unit that prints visual information on a non-recording surface of a recording medium, which is detachably attached and rotatably driven, by discharging ink droplets; and a control unit that controls movement of the printing unit in a radial direction of the rotatably driven recording medium, and that controls a discharge timing of the ink droplets discharged from the printing unit while rotatably driving the recording medium, wherein the printing unit includes a plurality of ink droplet discharge nozzles, arrayed in a line in the radial direction of the recording medium, that discharge ink droplets of different colors by the control of the control unit, and the control unit completes the printing of the visual information by moving the print unit to reciprocate a radius of the rotatably drive recording medium plural times, and the control unit determines a number of times to reciprocate the print unit based on a discharge interval in which the ink droplets are stably discharged from the ink droplet discharge nozzles.

2. A printing apparatus comprising:

a printing unit that prints visual information on a non-recording surface of a recording medium, which is detachably attached and rotatably driven, by discharging ink droplets; and a control unit that controls movement of the printing unit in a radial direction of the rotatably driven recording medium, and that controls a discharge timing of the ink droplets discharged from the printing unit while rotatably driving the recording medium, wherein the printing unit includes a plurality of ink droplet discharge nozzles, arrayed in a line in the radial direction of the recording medium, that discharge ink droplets of different colors by the control of the control unit, and the control unit completes the printing of the visual information by moving the print unit to reciprocate a radius of the rotatably drive recording medium plural times, and the control unit determines a number of times to reciprocate the print unit based on a pause period of at least one ink droplet discharge nozzle pausing the discharge of the ink droplets of the ink droplet discharge nozzles.

3. A printing method comprising:

generating printing data of visual information to print on a non-recording surface of a recording medium, which is detachably attached and rotatably driven;

printing, while the recording medium is rotating, the visual information on the non-recording surface of the recording medium by moving a print unit to reciprocate a radius of the recording medium plural times, wherein the print unit includes a plurality of ink droplet discharge nozzles, which are arrayed in a line in a radial direction of the recording medium and which discharge ink droplets of different colors; and determining a number of times to reciprocate the print unit in view of a discharge interval in which the ink droplets are stably discharged from the ink droplet discharge nozzles.

4. A printing method comprising:

generating printing data of visual information to print on a non-recording surface of a recording medium, which is detachably attached and rotatably driven;

printing, while the recording medium is rotating, the visual information on the non-recording surface of the recording medium by moving a print unit to reciprocate a radius of the recording medium plural times, wherein the print unit includes a plurality of ink droplet discharge nozzles, which are arrayed in a line in a radial direction of the recording medium and which discharge ink droplets of different colors; and determining a number of times to reciprocate the print unit in view of a pause period of at least one ink droplet discharge nozzle pausing the discharge of the ink droplets of the ink droplet discharge nozzles.

5. A non-transitory computer readable storage medium encoded with instructions, which when executed by a computer causes the computer to implement a method comprising:

generating printing data of visual information to print on a non-recording surface of a recording medium, which is detachably attached and rotatably driven;

printing, while the recording medium is rotating, the visual information on the non-recording surface of the recording medium by moving a print unit to reciprocate a radius of the recording medium plural times, wherein the print unit includes a plurality of ink droplet discharge nozzles, which are arrayed in a line in a radial direction of the recording medium and which discharge ink droplets of different colors; and determining a number of times to reciprocate the print unit in view of a discharge interval in which the ink droplets are stably discharged from the ink droplet discharge nozzles.

6. A non-transitory computer readable storage medium encoded with instructions, which when executed by a computer causes the computer to implement a method comprising:

generating printing data of visual information to print on a non-recording surface of a recording medium, which is detachably attached and rotatably driven;

printing, while the recording medium is rotating, the visual information on the non-recording surface of the recording medium by moving a print unit to reciprocate a radius of the recording medium plural times, wherein the print unit includes a plurality of ink droplet discharge nozzles, which are arrayed in a line in a radial direction of the recording medium and which discharge ink droplets of different colors; and determining a number of times to reciprocate the print unit in view of a pause period of at least one ink droplet discharge nozzle pausing the discharge of the ink droplets of the ink droplet discharge nozzles.

* * * * *